United States Patent [19]

Billottet et al.

[11] 3,974,740

[45] Aug. 17, 1976

[54] SYSTEM FOR AIMING PROJECTILES AT CLOSE RANGE

[75] Inventors: Henri Billottet; Patrice Fechner, both of Paris, France

[73] Assignee: Thomson-CSF, Paris, France

[22] Filed: Feb. 14, 1972

[21] Appl. No.: 225,801

[30] Foreign Application Priority Data

Feb. 17, 1971 France ..... 71.05366

[52] U.S. Cl. ..... 89/41 SW; 89/1 L; 89/41 AA; 89/41 SM; 89/127

[51] Int. Cl.[2] ..... F41G 5/08

[58] Field of Search ..... 89/1 L, 1.813, 1.814, 89/41 R, 41 A, 41 B, 41 E, 41 AA, 41 M, 41 L, 41 SW, 41 SM, 126, 127

[56] References Cited

UNITED STATES PATENTS 282,549 8/1883 McLean et al. ..... 89/1 L

FOREIGN PATENTS OR APPLICATIONS 1,164,107 9/1969 United Kingdom ..... 89/126

*Primary Examiner*—Stephen C. Bentley
*Attorney, Agent, or Firm*—Karl F. Ross; Herbert Dubno

[57] ABSTRACT

A multiplicity of launching tubes for nonguided projectiles, clustered about a central axis, are divided into several groups of 2n tubes each, the muzzles of each group of tubes being trained in directions diverging from one another in at least one dimension at a small angle designed to spread the projectiles of each group over a predetermined segment of an area centered on the main axis. The tubes of each group are subdivided into pairs whose muzzles are distributed symmetrically about the main axis and which may be fired simultaneously to provide a balanced recoil. A computer determines from the output of a tracking radar the location of a region of uncertainty, centered on the calculated position of a target to be destroyed, and selects the group or groups whose segments cover that region whereupon the tubes of the selected group or groups are fired simultaneously or in rapid succession. The entire array may undergo a sweep motion in one dimension (e.g. azimuth) while the tubes, with axes diverging in the other dimension (elevation), fire repetitively to cover the assigned sector; this sweep motion is superimposed upon the computer-controlled tracking motion designed to keep the main axis of the array in line with the presumed target position as calculated for the moment of impact.

9 Claims, 23 Drawing Figures

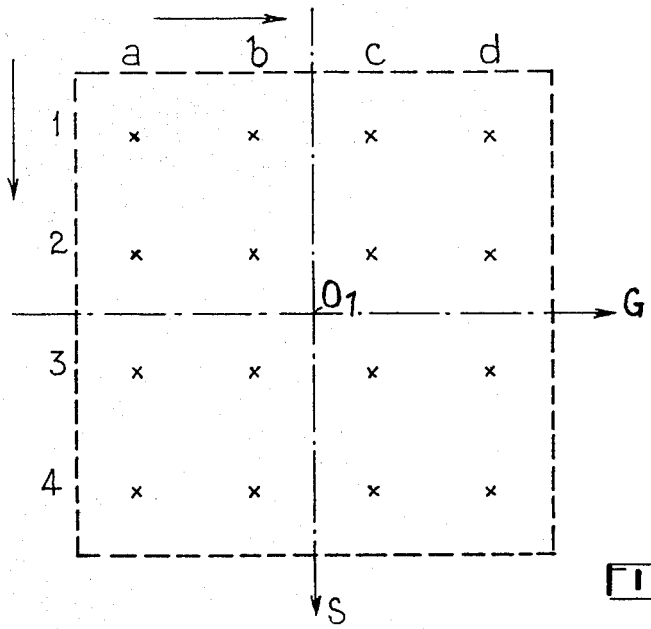

FIG. 10

| FIRING PULSES | 1 | 2 | 3 | 4 | 5 | 6 | 7 | 8 |
|---|---|---|---|---|---|---|---|---|
| T<br>$\tau \simeq 10ms$ | $t_i$ | $t_i+\tau$ | $t_i+2\tau$ | $t_i+3\tau$ | $t_i+4\tau$ | $t_i+5\tau$ | $t_i+6\tau$ | $t_i+7\tau$ |
| Salvo Nº 1 | A I<br>L VIII | G IV<br>F V | A II<br>L VII | G III<br>F VI | A III<br>L VI | G II<br>F VII | A IV<br>L V | G I<br>F VIII |
| Salvo Nº 2 | B I<br>K VIII | H IV<br>E V | B II<br>K VII | H III<br>E VI | B III<br>K VI | H II<br>E VII | B IV<br>K V | H I<br>E VIII |
| Salvo Nº 3 | C I<br>J VIII | I IV<br>D V | C II<br>J VII | I III<br>D VI | C III<br>J VI | I II<br>D VII | C IV<br>J V | I I<br>D VIII |
| Salvo Nº 4 | D I<br>I VIII | J IV<br>C V | D II<br>I VII | J III<br>C VI | D III<br>I VI | J II<br>C VII | D IV<br>I V | J I<br>C VIII |
| Salvo Nº 5 | E I<br>H VIII | K IV<br>B V | E II<br>H VII | K III<br>B VI | E III<br>H VI | K II<br>B VII | E II<br>H V | K I<br>B VIII |
| Salvo Nº 6 | F I<br>G VIII | L IV<br>A V | F II<br>G VII | L II<br>A VI | F III<br>G VI | L II<br>A VII | F IV<br>G V | L I<br>A III |

FIG. 12

| | | | | | | | | | |
|---|---|---|---|---|---|---|---|---|---|
| 17a | LAUNCHERS | AI | AII | AIII | AIV | BI | BII | BIII | BIV |
| | ELEVATIONAL ANGLE $\eta$ (mrad) | 4.5 | 3 | 1.5 | 0 | 4.5 | 3 | 1.5 | 0 |
| 17b | HORIZONTAL DIVERGENCE $\delta$ (mrad) | 0 | 0 | 0 | 0 | 0 | 0 | 0 | 0 |
| 17c | FIRING ORDER | 1 | 2 | 3 | 4 | 5 | 6 | 7 | 8 |
| | TIME t (msec) | 0 | 5 | 10 | 15 | 20 | 25 | 30 | 35 |
| | SWEEP ANGLE $\varphi$ (mrad) → | 0 | 0.625 | 1.25 | 1.875 | 2.5 | 3.125 | 3.75 | 4.375 |
| | AZIMUTH ANGLE $\alpha = \varphi - \delta$ (mrad) | 0 | 0.625 | 1.25 | 1.875 | 2.5 | 3.125 | 3.75 | 4.375 |
| 17d | HORIZ'AL DIVERGENCE $\delta$ (mrad) → | 0 | 0.625 | 1.25 | 1.875 | 0 | 0.625 | 1.25 | 1.875 |
| 17e | FIRING ORDER | 13 | 14 | 15 | 16 | 9 | 10 | 11 | 12 |
| | TIME t (msec) | 60 | 65 | 70 | 75 | 40 | 45 | 50 | 55 |
| | SWEEP ANGLE $\varphi$ (mrad) ← | 7.5 | 8.125 | 8.75 | 9.325 | 5 | 5.625 | 6.25 | 6.875 |
| | AZIMUTH ANGLE $\alpha = \varphi - \delta$ (mrad) | 7.5 | 7.5 | 7.5 | 7.5 | 5 | 5 | 5 | 5 |
| 17f | FIRING ORDER | 4 | 3 | 2 | 1 | 8 | 7 | 5 | 6 |
| | TIME t (msec) | 15 | 10 | 5 | 0 | 35 | 30 | 25 | 20 |
| | SWEEP ANGLE (mrad) | 1.875 | 1.25 | 0.625 | 0 | 4.375 | 3.75 | 3.125 | 2.5 |
| | AZIMUTH ANGLE $\alpha = \varphi + \delta$ (mrad) | 1.875 | 1.875 | 1.875 | 1.875 | 4.375 | 4.375 | 4.375 | 4.375 |
| 17g | HORIZ'AL DIVERGENCE $\delta$ (mrad) → | 0 | 1.25 | 0 | 1.25 | 0 | 1.25 | 0 | 1.25 |
| 17h | FIRING ORDER | 1 | 2 | 3 | 4 | 5 | 6 | 7 | 8 |
| | TIME t (msec) | 0 | 10 | 20 | 30 | 40 | 50 | 60 | 70 |
| | SWEEP ANGLE $\varphi$ (mrad) ← | 0 | 1.25 | 2.5 | 3.75 | 5 | 6.25 | 7.5 | 8.75 |
| | AZIMUTH ANGLE $\alpha = \varphi - \delta$ (mrad) | 0 | 0 | 2.5 | 2.5 | 5 | 5 | 7.5 | 7.5 |
| 17i | FIRING ORDER | 2 | 1 | 4 | 3 | 6 | 5 | 8 | 7 |
| | TIME t (msec) | 10 | 0 | 30 | 20 | 50 | 40 | 70 | 60 |
| | SWEEP ANGLE $\varphi$ (mrad) → | 1.25 | 0 | 3.75 | 2.5 | 6.25 | 5 | 8.75 | 7.5 |
| | AZIMUTH ANGLE $\alpha = \varphi + \delta$ (mrad) | 1.25 | 1.25 | 3.75 | 3.75 | 6.25 | 6.25 | 8.75 | 8.75 |

M

N

P

W

FIG. 17A

| | CI | CII | CIII | CIV | DI | DII | DIII | DIV |
|---|---|---|---|---|---|---|---|---|
| M | 4.5 | 3 | 1.5 | 0 | 4.5 | 3 | 1.5 | 0 |
| | 0 | 0 | 0 | 0 | 0 | 0 | 0 | 0 |
| | 9 | 10 | 11 | 12 | 13 | 14 | 15 | 16 |
| | 40 | 45 | 50 | 55 | 60 | 65 | 70 | 75 |
| | 5 | 5.625 | 6.25 | 6.875 | 7.5 | 8.125 | 8.75 | 9.375 |
| | 5 | 5.625 | 6.25 | 6.875 | 7.5 | 8.125 | 8.75 | 9.375 |
| N | 0 | 0.625 | 1.25 | 1.875 | 0 | 0.625 | 1.25 | 1.875 |
| | 5 | 6 | 7 | 8 | 1 | 2 | 3 | 4 |
| | 20 | 25 | 30 | 35 | 0 | 5 | 10 | 15 |
| | 2.5 | 3.125 | 3.75 | 4.275 | 0 | 0.625 | 1.25 | 1.875 |
| | 2.5 | 2.5 | 2.5 | 2.5 | 0 | 0 | 0 | 0 |
| | 12 | 11 | 10 | 9 | 16 | 15 | 14 | 13 |
| | 55 | 50 | 45 | 40 | 75 | 70 | 65 | 60 |
| | 6.875 | 6.25 | 5.625 | 5 | 9.375 | 8.75 | 8.125 | 7.5 |
| | 6.875 | 6.875 | 6.875 | 6.875 | 9.375 | 9.375 | 9.375 | 9.375 |
| P | 1.25 | 0 | 1.25 | 0 | 1.25 | 0 | 1.25 | 0 |
| | 8 | 7 | 6 | 5 | 4 | 3 | 2 | 1 |
| | 70 | 60 | 50 | 40 | 30 | 20 | 10 | 0 |
| | 8.75 | 7.5 | 6.25 | 5 | 3.75 | 2.5 | 1.25 | 0 |
| | 7.5 | 7.5 | 5 | 5 | 2.5 | 2.5 | 0 | 0 |
| W | 7 | 8 | 5 | 6 | 3 | 4 | 1 | 2 |
| | 60 | 70 | 40 | 50 | 20 | 30 | 0 | 10 |
| | 7.5 | 8.75 | 5 | 6.25 | 2.5 | 3.75 | 0 | 1.25 |
| | 8.75 | 8.75 | 6.25 | 6.25 | 3.75 | 3.75 | 1.25 | 1.25 |

Fig. 17B

SYSTEM FOR AIMING PROJECTILES AT CLOSE RANGE

Our present invention relates to a system for controlling the firing of nonguided projectiles to be aimed at close range upon a target to be attacked, e.g. an apporaching missile.

In commonly owned British Pat. No. 1,164,107, published Sept. 17, 1969, there has been disclosed a system of this general type wherein projectiles are launched simultaneously or in close succession from a cluster of tubes whose axes diverge from one another at small angles so that the resulting salvo covers a predetermined area of uncertainty surrounding the presumed location of the target as established by a tracking radar. Generally, this area of uncertainty may be regarded as circular, i.e. as a great circle of a spherical volume of uncertainty surrounding the presumed location. In some instances, however, the region (volume or area) of uncertainty may have a different configuration, as in the case of a target flying low above the ocean so that the radar image is affected by ground clutter elongating that region in a vertical direction.

The general object of our present invention is to provide an improved firing-control system of this character which can be more readily adapted to regions of uncertainty of different sizes and/or configurations, thereby increasing the efficiency of the weapon described in the above-identified British patent.

A related object is to provide a system of this type wherein only a selected number of the available launching tubes need to be actuated in many instances to fire a salvo at a target within range.

Another important object, allied with the preceding one, is to provide a firing system in which the effect of recoil upon the orientation of the array is perfectly balanced during each shot, regardless of the number and angular position of the tubes selected for firing the salvo.

pursuant to a feature of the present invention, the array of projectile-emitting tubes (e.g. gun barrels or rocket launchers) is divided into a plurality of launcher groups, the launchers of each group having muzzles trained upon different parts of an assigned segment of a predetermined region of uncertainty centered on the presumed target position; a trigger stage, operable by a computer responsive to the associated tracking radar, actuates the launchers of a selected group within a predetermined firing period with simultaneous emission of projectiles from combinations of launchers within the group whose muzzles are symmetrically distributed about the axis of the array, or main axis, for a balanced recoil effect.

The smallest number of launchers capable of providing such a balanced recoil effect is a pair of launchers having muzzles in diametrically opposite positions with reference to the main axis; in the simplest mode of realization of this aspect of the invention, therefore, the tubular launchers are arranged in such pairs, the number of launchers in each group being even. The pairs of each group are fired either simultaneously or in rapid succession, as described for individual tubes in the aforementioned British patent. Thus, for convenience, each group may consist of 2n launchers, even though it is not absolutely essential that the number of launchers by the same for all groups.

According to another feature of our invention, the array of launching tubes may undergo a rotary motion in the other dimension at a rate of rotation enabling group to sweep the assigned segment within the predetermined firing period.

The selection of one or more groups for the firing of each salvo, and the possible changeover from one grouping to another in successive salvos, is carried out by the computer in response to such parameters as the nature and shape of the target, its trajectory relative to the firing point and the presence or absence of reflecting objects which may affect the region of uncertainty. With the projectiles fired from the launchers of each group having zones of effectiveness which overlap throughout the assigned segment within a predetermined distance, a range finder in the computer establishes the firing period as soon as a target comes within that distance.

The invention will be described in greater detail hereinafter with reference to the accompanying drawing in which:

FIG. 10 is a modified plot similar to FIG. 3;

FIG. 12 is a table relating to the firing order of several groups in the array of FIG. 11;

FIG. 15 is an array similar to FIG. 11 but using the representation of. FIG. 14;

FIGS. 17A and 17B are a table indicating the firing order of a group of launchers in a modified system according to our invention;

Figure 1:
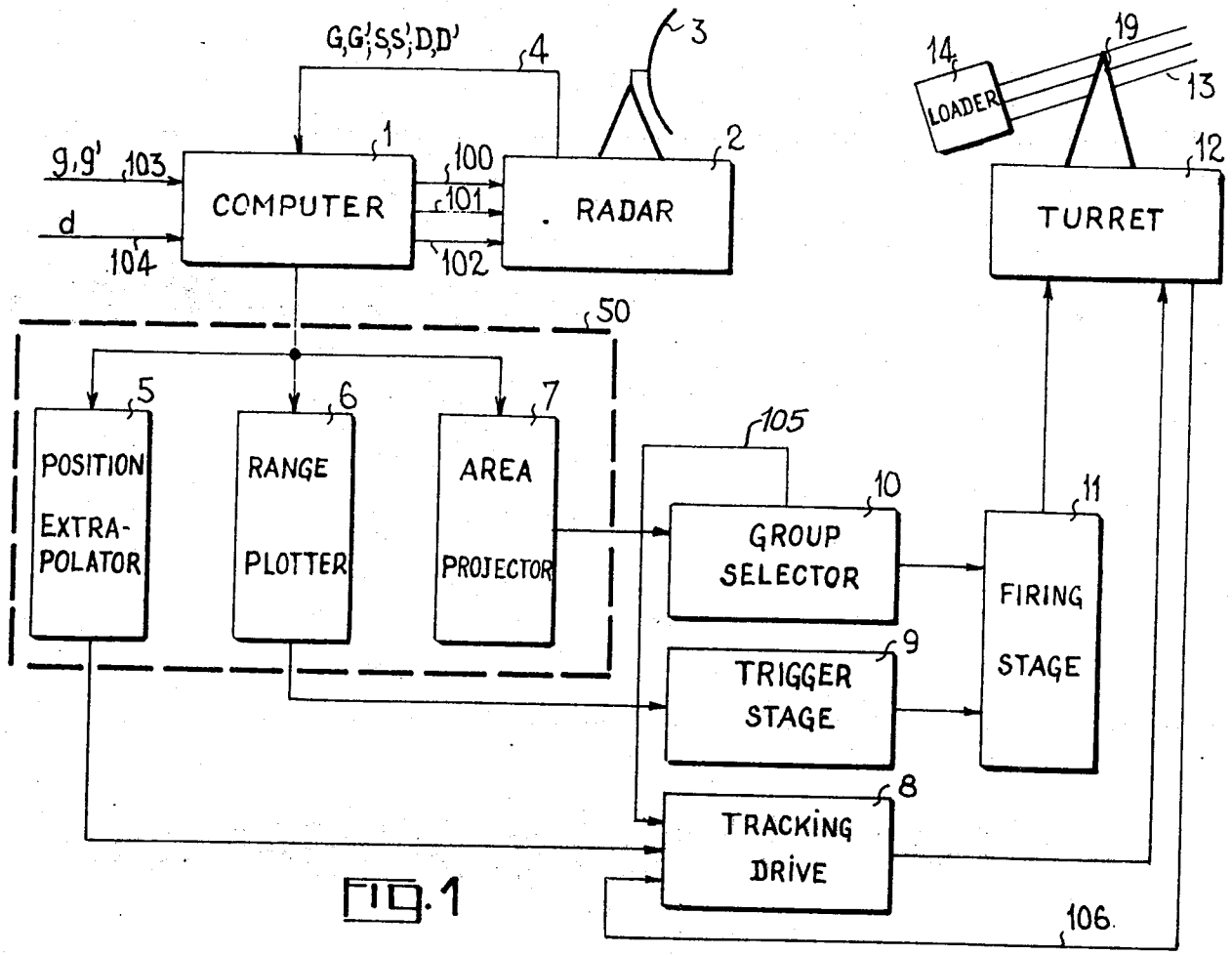
FIG. 1 is an overall block diagram of a representative embodiment.

The system shown in FIG. 1 comprises a computer 1 controlling a tracking radar with aerial 3, in response to input signals fed in (e.g. manually) via leads 103, 104, i.e. signals $g$ $g'$ respectively determining the azimuthal sweep and the speed of rotation of the aerial 3 about its vertical axis and the target range or distance $d$ within which interception is to take place. Corresponding commands are transmitted from the computer, via lines 100, 101 and 102, to the radar 2 which, over a line 4, feeds back signals G, G′ on the azimuthal position and speed of a target onto which the radar has locked, signals S, S′ relating to the elevation of such target and its angular velocity in a vertical plane, and signals D, D′ giving its distance and radial speed. The computer processes this information and relays it to a controller 50 which includes a position extrapolator 5, a range plotter 6 and an area projector 7. Component 5 precalculates the future mean target position for the instant at which a projectile leaving the firing point reaches the target area. Component 6 determines, from the position and movement of the target, the time when the latter will be within firing range, i.e. the "window" available for actuating the launchers in one, two or possibly more salvos, taking into account the probability of destruction of the target by a single shot; if this probability is sufficiently high, the computer may direct the radar to latch onto a different target even before the maximum possible number of salvos have been fired. Component 7 establishes, from the fluctuations of the apparent target position and other factors (e.g. proximity to soil or water), the area of uncertainty within which the actual target position may deviate from its presumed position.

The output of position extrapolator 5 controls a tracking drive 8 for a gun 13 pivotally mounted at 19 on a turret 12, drive 8 including a motor for the rotation of the turret and a servomechanism for changing the inclination of the weapon relative to the horizontal. Range plotter 6 controls a trigger stage 9 which establishes the firing period for the launching tubes of the gun 13 and, during such period, actuates a firing stage 11 operatively connected with these tubes. Area projector 7 operates a group selector 10 which, by inhibiting the firing of certain tubes under the control of stage 11, sets up a grouping of active launchers corresponding to the area of uncertainty established by that projector. An output 105 of group selector 10 also goes to tracking drive 8 for a proper aiming of the active launchers; the azimuthal and elevational position of the gun 13 is reported back to drive 8 via a line 106. A conventional loader for the tubular launchers of gun 13 has been indicated at 14.

Figure 2:
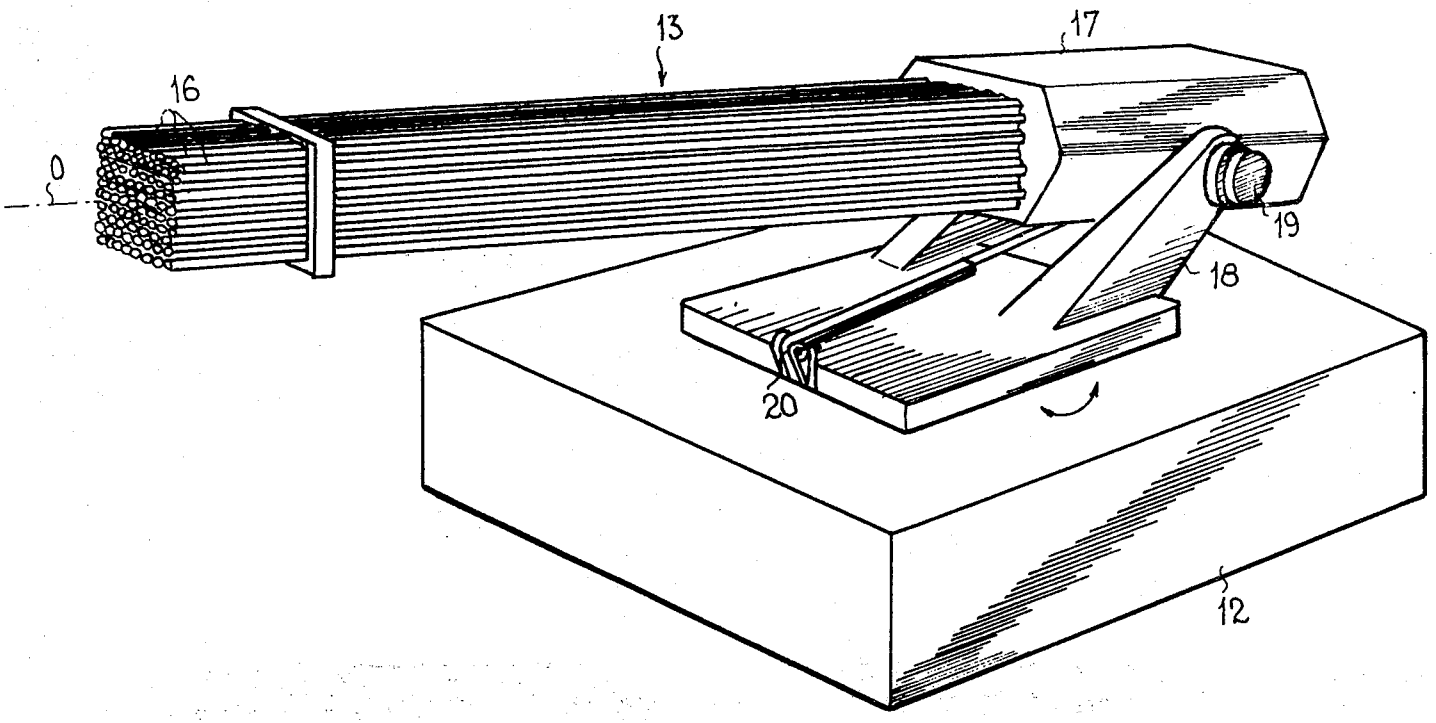
FIG. 2 is a perspective view of a gun forming part of the system of FIG. 1.

FIG. 2 illustrates the construction of weapon 13 whose turret 12 is shown as a square base supporting a gun mount 18 on which a casing 17 is swingably mounted by the pivot joint 19; the loading mechanism 14 of FIG. 1, omitted in this view, is so dimensioned and positioned that the center of gravity of the swingable gun body coincides with the pivotal axis. The aforementioned servomechanism for elevating the weapon is represented by a hydraulic jack 20. The weapon proper comprises an array of generally parallel launching tubes 16, clustered about a common axis O, which could be either gun barrels or rocket launchers; in the latter instance, the projectiles fired from these tubes may carry explosive charges or other propellants to enhance their speed without altering the direction imparted to them by the slightly diverging muzzles of the launchers.

In practice, the number of launching tubes 16 may be on the order of 100, each tube having for example a length of 3 meters and a caliber of about 40 mm. In a specific embodiment more fully described below, their angular divergence may range between about 1 and 1.5 milliradians in the vertical plane and may amount to about 2.5 milliradians in the horizontal plane. The overall cross-section of the array may measure 55 × 45 cm, the weight of the weapon in this case being approximately 700 kg. Naturally, the number of tubes in the array could be considerably increased if the greater bulk and weight can be tolerated.

As already noted above and pointed out in British Pat. No. 1,164,107, the active tubes of this array are to be fired simultaneously or in so rapid succession that the position of the target changes only insignificantly between firing of the first and last shots of the salvo.

Figure 3:
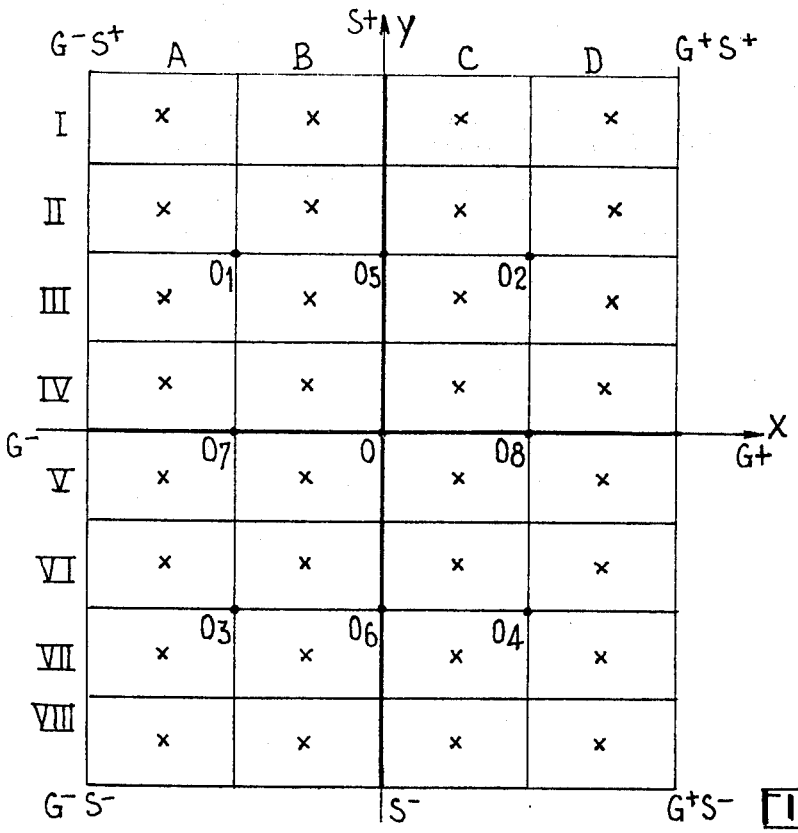
FIG. 3 is a plot of the theoretical points of impact of nonguided projectiles fired in a salvo from the gun of FIG. 2.

In FIG. 3 we have indicated by crosses the theoretical points of intersection of the trajectories of 32 projectiles, fired from as many tubes 16 of gun 13, with a transverse plane centered on the main axis O of the array; this theoretical position disregards the possible straying of any projectile from the individual muzzle axis. Let us assume that the plane of FIG. 3, which contains the area of uncertainty centered on axis O (with the gun trained upon the presumed target position), is located at a distance of 2,000 meters from the site of the weapon and that the 32 launching tubes here considered have the aforementioned relative angular deviation of 2.5 milliradians in azimuth and 1.5 milliradians in elevation. These values are based upon an assumed zone of destruction of 3 × 5 meters, as represented by the small rectangles in FIG. 3, for each individual projectile. At the postulated distance of 2,000 meters, the theoretical impact points of the several projectiles are space apart 3 meters vertically and 5 meters horizontally so that their zones of destruction adjoin one another without intervening gaps.

The 32 active launchers represented by the array of FIG. 3 are divided into four groups of eight launchers each, respectively trained upon the four quadrants of the area of FIG. 3 defined by the orthogonal axes *x* and *y*. The 32 elemental rectangles are arrayed in four columns A, B, C, D and eight rows numbered from I to VIII. Axis *x* bears designations $G^-$ and $G^+$ for negative and positive azimuth angles relative to the central axis O; axis *y* is similarly marked with $S^+$ and $S^-$ for positive and negative elevations with reference to that axis. Thus, the segment in the upper left quadrant assigned to the first group of eight launchers, centered on an axis $O_1$, has been designated $G^- S^+$; the second group covers the upper right segment $G^+ S^+$, centered on an axis $O_2$, whereas the third and fourth groups are aimed at segments $G^-S^-$ and $G^+S^-$ centered on respective axes $O_3$ and $O_4$. The combination of the first two groups has a center $O_5$, that of the last two groups having a center $O_6$; similarly, $O_7$ and $O_8$ are the centers of the combinations of the first and third groups and of the second and fourth groups, respectively.

The four segmental areas of FIG. 3, each encompassing eight zones of distribution, are assigned to corresponding eight-launcher groups of gun 13 which therefor must have a minumum of 32 tubes 16 in this instance. In practice, however, it will be desirable to assign each of these segmental areas to a plurality of launcher groups, e.g. to three such groups if 96 tubes 16 are available. This has been schematically illustrated in FIG. 4 where a total of 12 groups (three for each segmental area of FIG. 3) are represented by respective blocks labeled G1–G12; the arrows emanating from each block, bearing the designations $G^-$, $G^+$ and $S^-$, $S^+$, identify the segmental area or quadrant upon which the launchers of each group are trained.

Thus, area $G^-S^+$ has been assigned to the first three groups G1, G2 and G3, area $G^-S^-$ is covered by the next three groups G4, G5 and G6, area $G^+S^+$ belongs to groups G7, G8 and G9, and area $G^-S^+$ is the territory of groups G10, G11 and G12.

Figure 4:
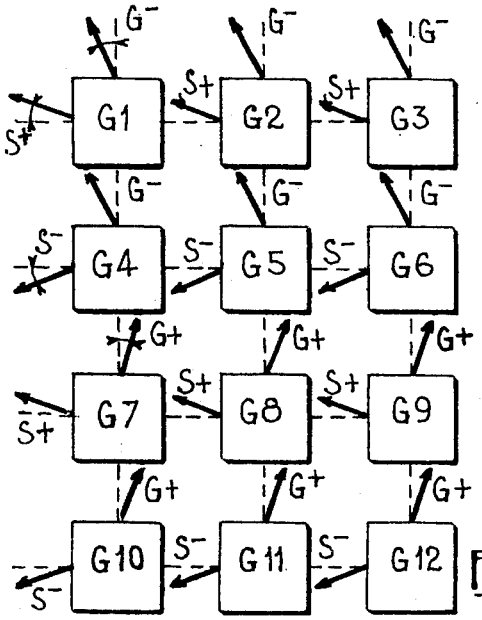
FIG. 4 shows, diagrammatically, the grouping of an array of launching tubes in the gun of FIG. 2 to cover the area represented by the plot of FIG. 3.

If a combination of two or more segmental areas is to be taken under fire, one group each of a corresponding number of horizontal rows in FIG. 4 is selected; for successive salvos in the same direction, different groups of a row are chosen so that the weapon can fire without reloading.

Figure 5:
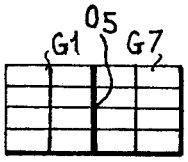
FIG. 5, 6 and 7 are plots showing different segments of that area assigned to various groups in the array of FIG. 4.
Figure 7:
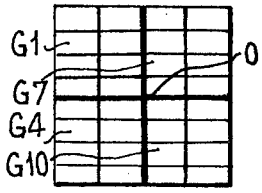
Figure 6:
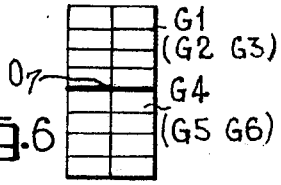

According to FIG. 5, for example, the area under fire is the one centered on axis $O_5$ and consists of the two upper quadrants in FIG. 3; launcher groups G1 and G7 are selected for the salvo. In FIG. 6 the area is centered on axis $O_7$ and consists of the two left-hand quadrants in FIG. 3; the selected groups are G1 and G4. FIG. 7 the case when the entire region of FIG. 3 is to be bracketed; here the active launchers are in groups G1, G4, G7 and G10. If successive salvos are to be fired upon the same region, e.g. that shown in FIG. 6, parallel groups such as G1, G2, G3 and G4, G5, G6 are successively activated as parenthetically indicated in that Figure.

The firing of a single group of launchers, covering for example an area of 2 × 4 zones as shown in FIG. 3 – 7, may be sufficient if the target is relatively large and moves in free space so that the area of uncertainty is small. In such a case, therefore, only a small fraction of the available ammunition is spent so that the gun remains ready for a number of further salvos.

Figure 8:
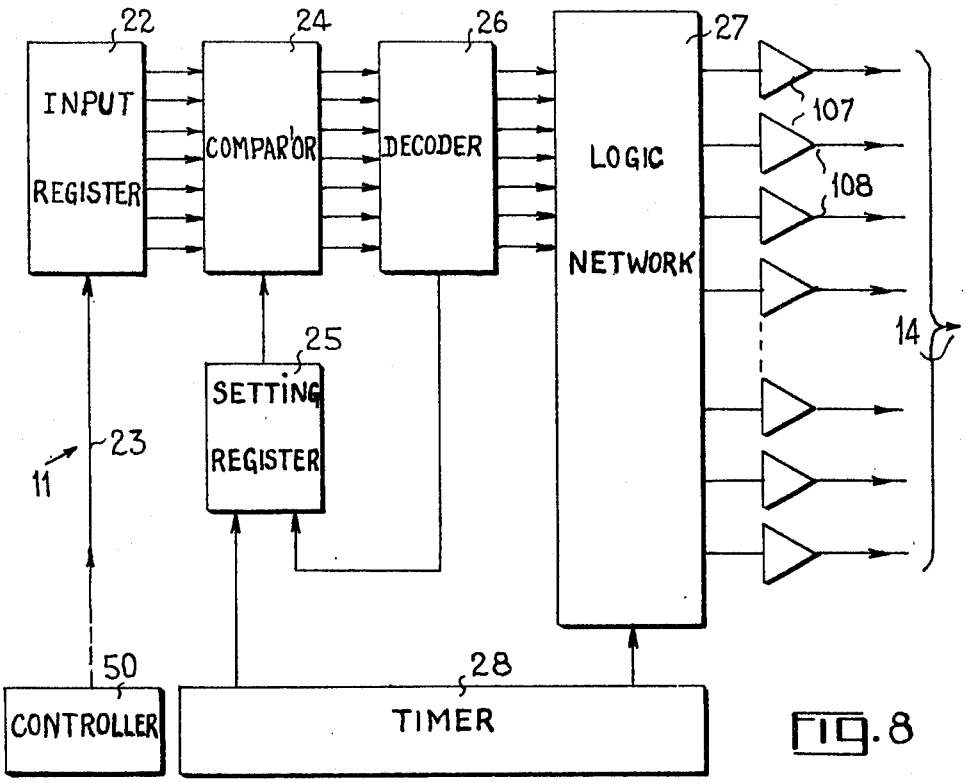
FIG. 8 is a more detailed block diagram of the final stage of the system of FIG. 1.

Naturally, the launchers of a group could also be differently arrayed (e.g. 2 × 2 or 3 × 3) and their zones of destruction may be considered square, rather than rectangular as indicated in FIG. 3.

in FIG. 8 we have shown in greater detail the firing stage 11 of FIG. 1. This stage comprises an imput register 22 obtaining the requisite data from controller 50 via a channel 23 which includes the stages 9 and 10 of FIG. 1. A comparator 24 receives both the data stored in input register 22 and the readings of a setting register 25 related to the state of operation of the gun as relayed to that register from a decoder 26 connected to the output of comparator 24. Register 25 is stepped by clock pulses from a timer 28 which successively identify the several launchers of the gun; since the launchers are to be fired in pairs, as discussed above and more fully described hereinafter, there will be 48 clock pulses in a timer cycle under the conditions assumed in connection with FIG. 4.

Decoder 26 works into a logic network 27 which also receives the clock pulses of timer 28 and whose output circuit, leading to the loader 14, includes as many individual power amplifiers 107 as there are launching tubes, i.e. 96 in the case specifically considered. Thus, the selective energization of an even number of output leads 108 of network 27, under the joint control of timer 28 and decoder 26, results in the firing of a salvo from one or more launcher groups as explained with reference to FIG. 3 – 7.

Figure 9:
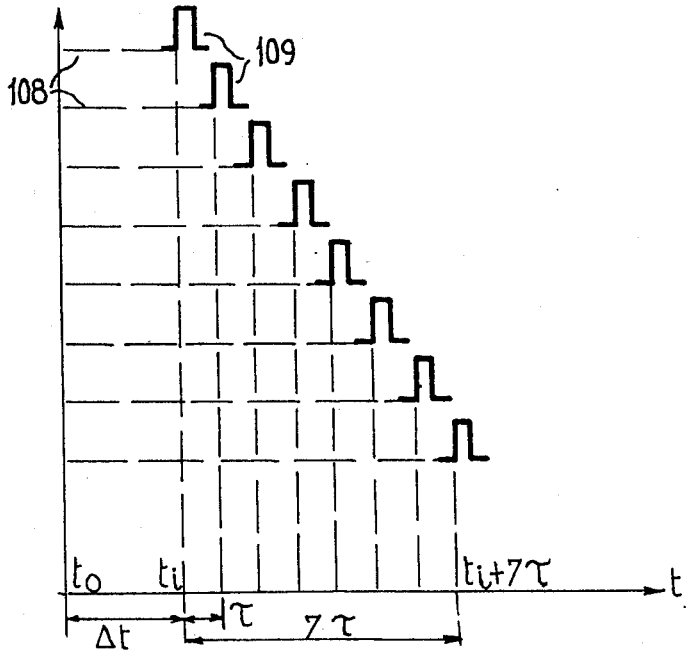
FIG. 9 is a time diagram showing the firing order of a group of launchers in that system.

In FIG. 9 we have shown a number of these output leads 108 together with firing pulses 109 appearing thereon for setting off a two-group salvo, involving the discharge of 16 projectiles against an area as shown in FIG. 5 or FIG. 6. The clock cycle starts at a time $t_o$, with the clock pulses (and therefore also the firing pulses 109) following one another at uniform intervals $\tau$ which may be on the order of 5 ms, for example. A delay period $\Delta t$, during which no clock pulses are generated, represents the time required by the firing stage 11 to process the information received from the computer. The salvo starts at a time $t_i = t_o + \Delta t$ and, with eight pairs of launchers to be successively actuated, terminates at time $t_i + 7\tau$.

We shall now describe the manner in which the pairing of simultaneously fired launchers is arranged in a system according to our invention.

FIG. 10 shows a segmental target area divided into four square subsegments of four zones each, the zones being arrayed in four columns *a*, *b*, *c*, *d* and four rows 1, 2, 3, 4 centered on the axis $O_1$ of that segment (cf. FIG. 3). Thus, the upper left subsegment encompasses zones *a*1, *a*2, *b*1, *1*2; the upper right subsegment consists of zones *c*1, *c*2, *d*1, *d*2; and so forth.

Figure 11:
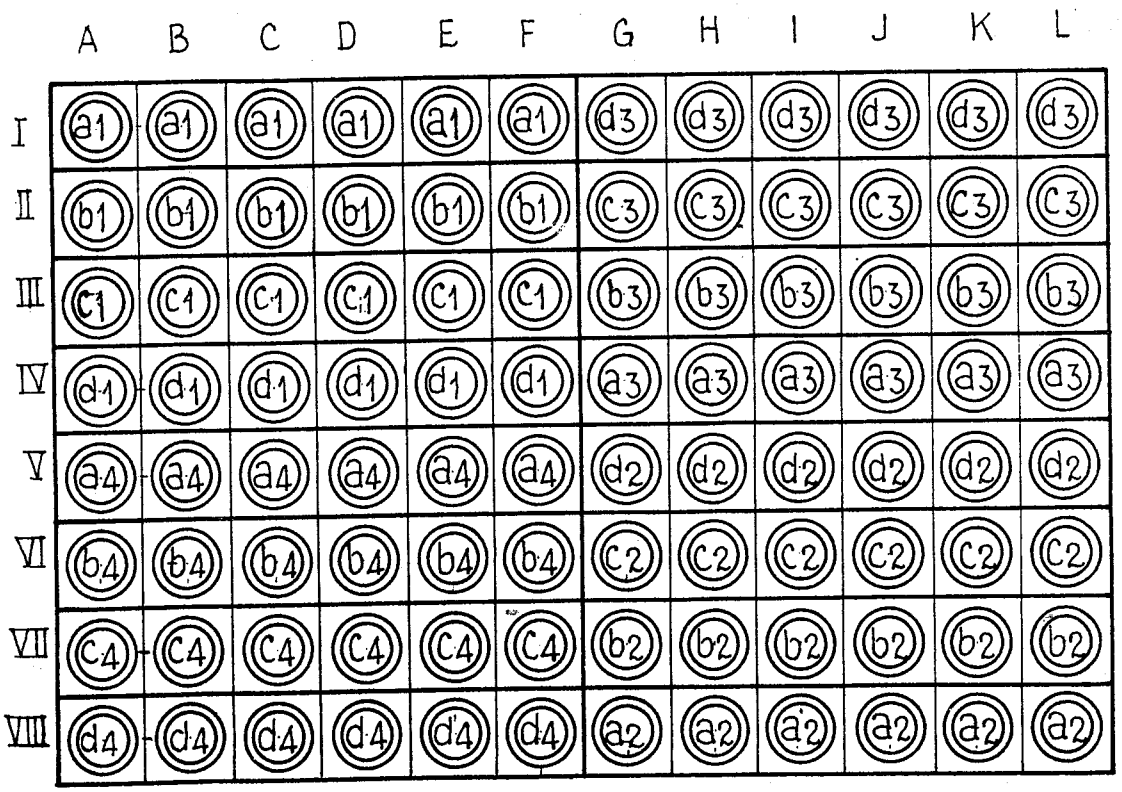
FIG. 11 is a schematic representation of a cluster of launching tubes in a somewhat different grouping.

FIG. 11 shows the 96 launchers trained upon these zones in four sets of siz groups each, there being thus six launchers for zone *a*1, six launchers for zone *a*2, and so on. An array of launchers (or, more exactly, of theiir muzzles) is divided into eight rows I – VIII and columns A – L with all the launchers trained upon a single zone (e.g. *a*l) occupying one half of a common row. The distribution of the tubes is such that the launchers assigned to any pair of vertically aligned zones within a subsegment (such as *a*1, *a*2 or *c*3, *c*4) are disposed at diametrically opposite locations with reference to the center of the array, i.e. to the main axis O of the cluster of tubes 16 in FIG. 2.

The firing sequence of these paired launchers is apparent from FIG. 12 which shows the timing of successive firing pulses, numbered from 1 to 8, which occur at instances, $t_i$, $t_i + \tau$, $t_i + 2\tau$ etc. (with $\tau$= 10 ms in this specific example); with 16 launchers participating in each salvo, up to six salvos can be fired in as many successive clock cycles.

FIG. 12 shows the first shot of the first salvo to involve the launchers identified by coordinates A I and L VIII in FIG. 11, i.e. the tubes at the upper left and the lower right corner of the array trained upon zones *a*1 and *a*2, respectively. The second shot is fired into zones *a*3 and *a*4 from array positions G IV and F V. In the third shot, tubes in positions A II and L VII hit the zones b1 and b2. In similar manner, the remaining ten zones of the segment of FIG. 10 are bombarded in the following five shots. The second salvo starts with array positions B I and K VIII, again firing into zones *a*1 and *a*2; in all six salvos, the zones of the segment are hit in the same sequence.

Figure 13:
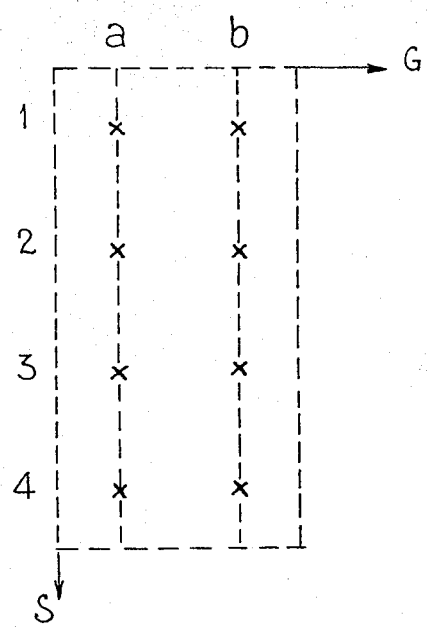
FIG. 13 is another plot of the type shown in FIGS. 3 and 10.

FIG. 13 is similar to FIG. 10 but shows a rectangular segment of eight zones arranged in two columns *a*, *b* and four rows 1, 2, 3, 4. This segment is representative of any of the four quadrants of an array of uncertainty, generally similar to that of FIG. 3, with the quadrants again identified by their positive or negative azimuthal and elevational designations $G^+$, $G^-$, $S^+$, $S^-$.

Figure 14:
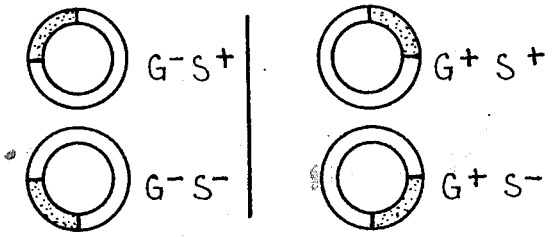
FIG. 14 is a schematic representation of different muzzle orientations.
Figure 15:
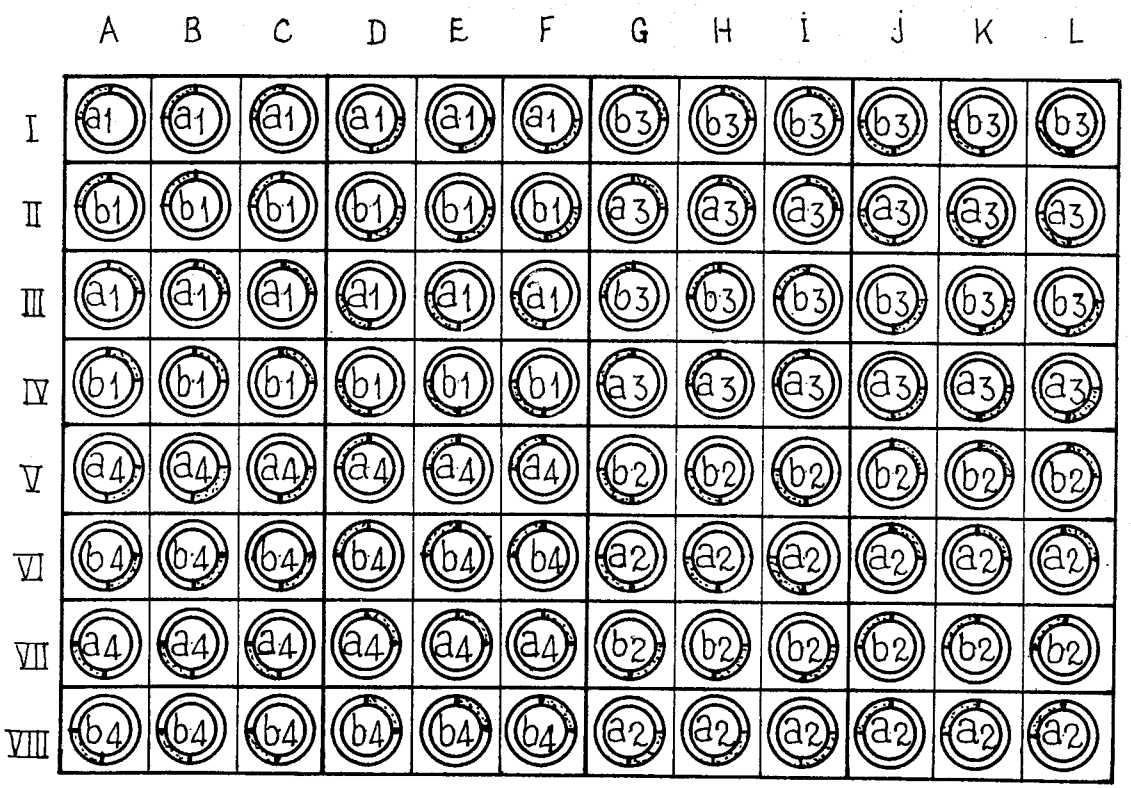

FIG. 14 shows the symbols adopted to distinguish these four quadrants in the table of FIG. 15, i.e. a darkened ring sector at upper left ($G^+S^-$), lower left ($G^-S^-$), upper right ($G^+S^+$) and lower right ($G^+S^-$).

In FIG. 15 the array of 96 tubes is again divided into eight rows I – VIII and 12 columns A – L, yet in this case only three groups of launchers are assigned to each of the four segments.

Figure 16:
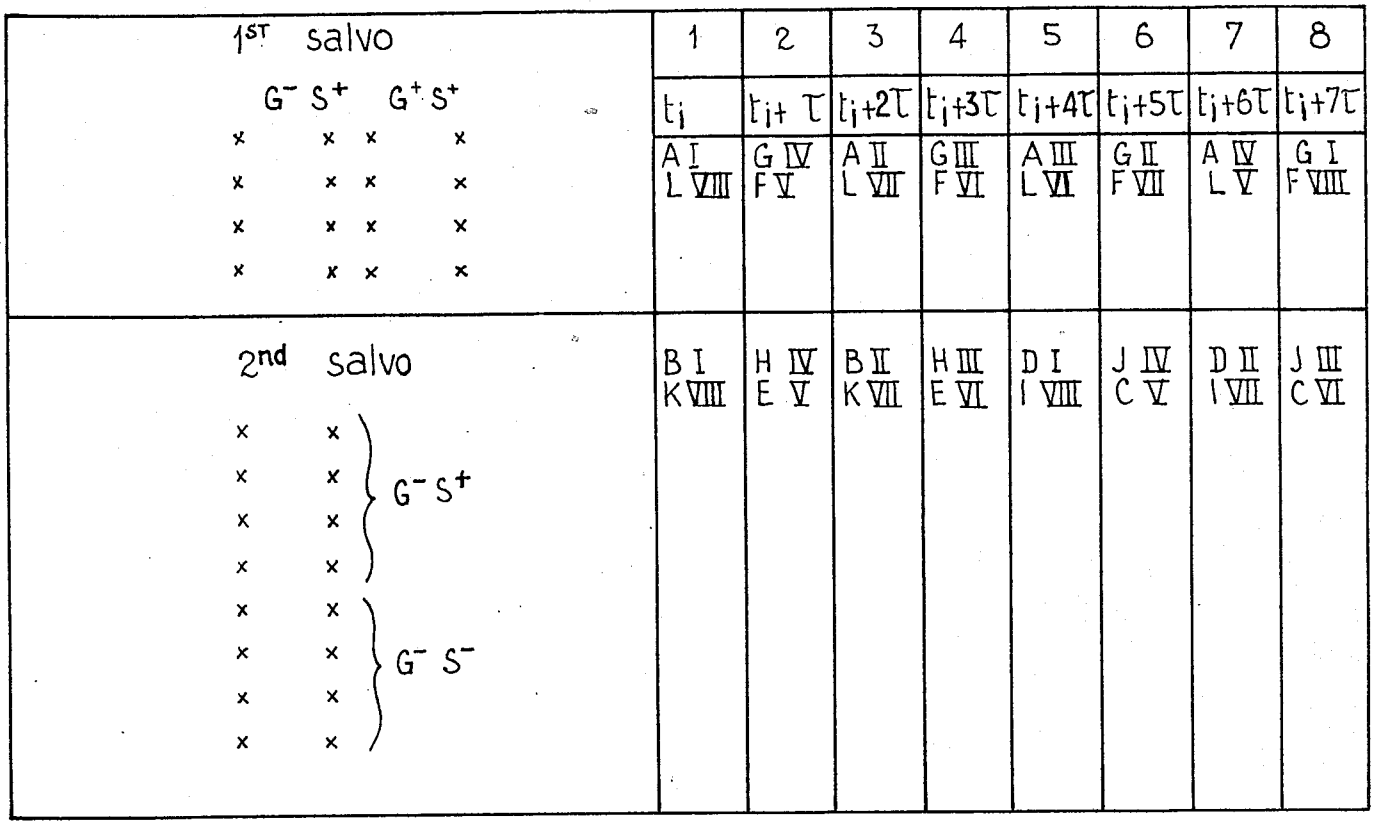
FIG. 16 is a table indicating the firing order for the grouping of launchers shown in FIG. 15.

FIG. 16 shows the firing order for these launchers in two successive salvos with a change in the configuration of the bombarded area. Thus, the first salvo covers the segments $G^-S^+$ and $G^+S^+$ (upper half of the overall area, see FIG. 5) whereas the second salvo is directed onto diagonally opposite segments $G^-S^+$ and $G^+S^-$. The first shot of the first salvo, involving array positions A I and L VIII, fires into zones *a*1 and *l*2 of the quadrant $G^-S^+$, the next three shots covering the remaining six zones of that quadrant; the fifth shot is directed from positions A III and L VI into zones *a*1 and *a*2 of quadrant $G^+S^+$, the three last shots hitting the remaining six zones of the latter quadrant. In the second salvo, the quadrant $G^-S^+$ is again hit by the first four shots, in the same order as before; the last four shots of that salvo are fired into the eight zones of quadrant $G^+S^-$.

In FIGS. 17A and 17B we have tabulated, for an array of 16 launching tubes diverging in one dimension (i.e. vertically) while rotating in the other dimension (horizontally), such operating parameters as their elevational angle $\eta$, horizontal divergence $\delta$, firing order and time $t$, sweep angle $\phi$ and azimuth angle $\alpha=\phi\pm\delta$, the sign of the latter term depending on the relative direction of the rotary sweep of the gun mount and the angular offset of the muzzle axxs in the path of rotation. The launchers here considered are the first 16 in the array of FIG. 11, i.e. those designated by rows I–IV and columns A-D.

From section FIG. 17A it will be noted that the four groups of four launchers each, represented by columns A, B, C and D, have the same vertical orientation, with $\eta$, = 4.5 milliradians for the tubes of row I, $\eta$= 3 mrad for those of row II, $\eta$= 1.5 mrad for the tubes of row III and $\eta$= 0 for the ones in row IV.

As shown in line 17 *b* of FIGS. 17A and 17B, which relates to the case represented by sections 17*c* thereof, the horizontal divergence $\delta$ of all the tubes from a reference position is zero. Upon the firing of the tubes in the order indicated in section 17*c*, at intervals $\tau$ of 5 msec, their axes include progressively larger sweep angles $\phi$ with the reference direction.

If we assume, as above, that the zone of destruction at 2000 m is 5m wide, corresponding to an azimuthal arc of 2.5 mrad, the speed of rotation of the gun turret should be such that the array sweeps this arc during the time interval $\tau$ between firings of corresponding tubes of adjoining groups of four, i.e. of tubes having the same elevational angle $\eta$. In this particular instance, the array rotates through an angle $\phi$ of 0.625 mrad during each interval $\tau = 5$ msec and, therefore, through 9.375 mrad during the entire firing period of 75 msec. At the instants of launching, accordingly, the axes of successive nozzles deviate from the reference direction by a progressively increasing angle $\alpha$ ranging from zero through 9.375 mrad. This has been plotted in FIG. 18 which shows a shifting of the theoretical points of impact, along horizontal lines 1 – 4, onto oblique lines diverging from the vertical lines *a* – *d* in the direction of the sweep here assumed to be from left to right.

In order to eliminate this shift, a compensatory divergence $\delta$ may be imparted to the launchers of each group as indicated in section 17*d* of FIGS. 17A and 17B. It will be noted that this horizontal divergence is identical for corresponding tubes of each group, i.e. $\delta = 0$ for the tubes of row I; $\delta = 0.625$ mrad for the tubes of row II; $\delta = 1.25$ mrad for the tubes of row III; and $\delta = 1.875$ mrad for the ones of row IV. With the horizontal offset of the tubes measured from left to right, and with a sweep of the turret from right to left, the firing order indicated in section 17*e* produces identical azimuth angles $\alpha=\phi-\delta$ for the tubes of each group, i.e. :

$\alpha = 7.5$ mrad for column A $\alpha = 5$ mrad for column B, $\alpha = 2.5$ mrad for column C, and $\alpha = 0$ for column D.

If the sweep is reversed, and if the firing order is altered as indicated in section 17*f* of FIGS. 17A and 17B, we obtain for $\alpha = \phi + \delta$ the following values :

$\alpha = 1.875$ mrad for column A, $\alpha = 4.375$ mrad for column B, $\alpha = 6.875$ mrad for column C, and $\alpha = 9.375$ mrad for column D.

Figure 19:
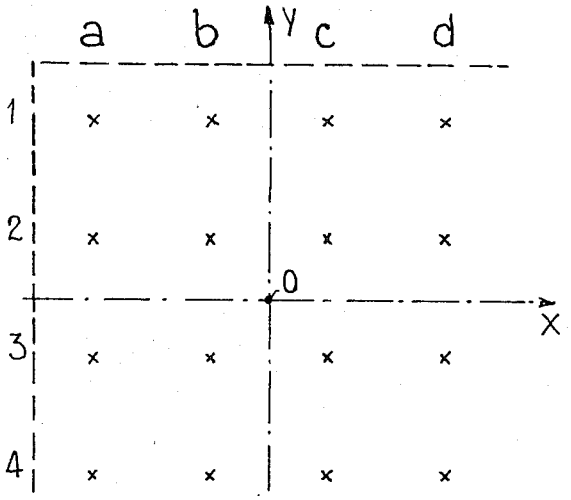
FIGS. 18 and 19 are further plots of the general type shown in FIG. 3 but relating to the system represented by FIGS. 17A and 17B.
Figure 18:
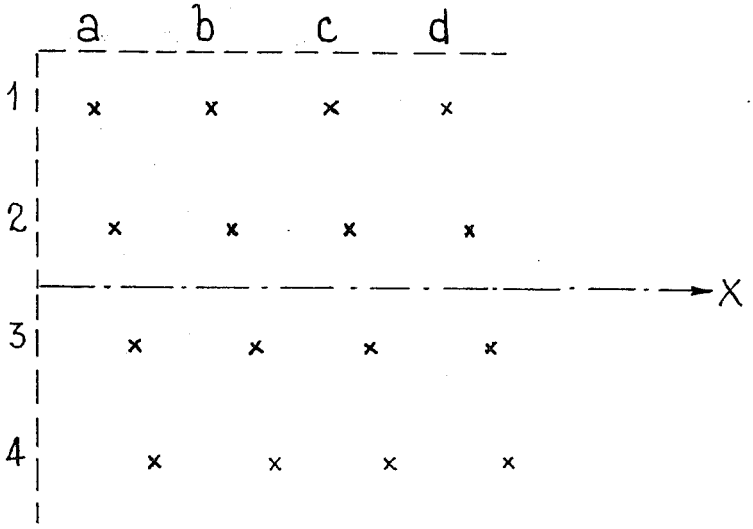

In both instances, therefore, the slanting plot of FIG. 18 is converted into an orthogonal plot as shown in FIG. 19. The two cases differ, however, by a relative shift of the vertical lines *a* – *d* by an angle of 1.875 mrad which, of course, can be compensated (if necessary) through a change in the timing of the first firing pulse.

As indicated in section 17*g*, a rearrangement of the divergence $\delta$ enables the tubes of such a rotary array to be fired in balanced pairs, it being assumed for purposes of this description that the array is limited to the 16 tubes of rows I–IV and columns A–D and that the axis of the array passes through the center of the rectangle thus defined. With the tubes in positions A I, A III, B I, B III, C II, C IV, D II and D IV parallel to the axis ($\delta$=0) and the remaining tubes diverging therefrom at an angle $\delta = 1.25$ mrad, an observation of the firing order and timing indicated in section 17*h* at the previously assumed rotary speed results in the following angles $\alpha=\phi-\delta$ for the several pairs of simultaneously fired tubes :

$\alpha = 0$ for A I / D IV and A II / D III $\alpha = 2.5$ mrad for A III / D II and A IV / D I, $\alpha = 5$ mrad for B I / C IV and B II/ C III, and $\alpha = 7.5$ mrad for B III / C II and B IV / C I.

Upon reversal of the sweep and modification of the firing order, as indicated in section 17*i*, we obtain the following azimuth angles $\alpha = \phi + \delta$ :

$\alpha = 1.25$ mrad for A I / D IV and A II / D III, $\alpha = 3.75$ mrad for A III / D II and A IV / D I, $\alpha = 6.25$ mrad for B I / C IV and B II / C III, and $\alpha = 8.75$ mrad for B III / C II and B IV / C i.

Again, therefore, we realize an orthogonal plot as illustrated in FIG. 19, with a slight relative shifting of the vertical lines *a* – *d* for the two sweep directions.

Naturally, the same azimuth angles can be established by firing at intervals of 5 msec (as in the case discussed with reference to table sections 17*b* – 17*f*) if the rotary speed is doubled.

With the use of a larger array subdivided into several groupings of 16 tubes each, e.g. as illustrated in FIG. 11, the tubes of two or more of these 16-tube combinations may again be fired in successive salvos into the same target area; this merely requires a suitable relative orientation of their muzzle axes as will be readily understood from the preceding discussion.

Furthermore, in the system represented by sections 17*g* – 17*i*, the number of launching tubes in the contemplated array or grouping may be cut in half by firing each launcher twice in succession, during the same salvo, into different parts of the assigned segment of the target area, such as the two sets of vertical zones *a* and *c* or *b* and *d*. Such consecutive firing is possible if, for example, each launching tube is equipped with two (or more) externally mounted squibs which are successively ignited and which release the vapors of their exploding charges into the tube for successively propelling two (or more) projectiles positioned in tandem therein. Thus, the function of the tubes of columns A and D could be taken over by the codirectionally oriented tubes of columns B and C, respectively, each tube firing twice at intervals of 40 msec (or 20 msec with the higher rotary speed).

Figure 20:
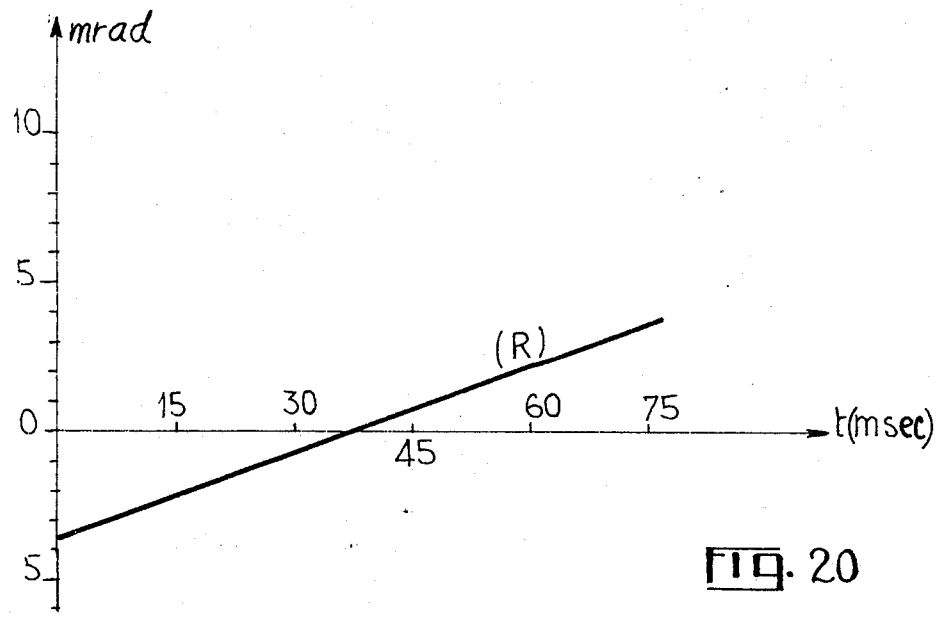
FIGS. 20 and 21 are time diagrams relating to the operation of a system as represented by the table of FIGS. 17A and 17B.

The sweep rotation at angular velocity $\omega$ may be periodically reversed with reloading of the previously discharged tubes during the return stroke. It should be understood that this reciprocating sweep is superimposed upon any azimuthal tracking motion to be executed by the turret. Thus, FIG. 20 shows the angular displacement (in terms of angle $\phi$ and time $t$) in the case of a target having only a radial motion; the rotation of the turret is then a linear function (R) representing the firing sweep discussed in connection with FIG. 17. If, however, the target has a lateral speed component as indicated by a line (A) in FIG. 21, the necessary tracking speed must be algebraically added (with the proper sign) to the sweep motion. If the target motion is codirectional with the sweep, the resulting angular displacement of the turret is given by a line (B) representing the addition of the two speed vectors; if it is opposite, as shown by a line (A′) symmetrical to the former, the differential combination of the two vectors yields another line (B′).

Figure 21:
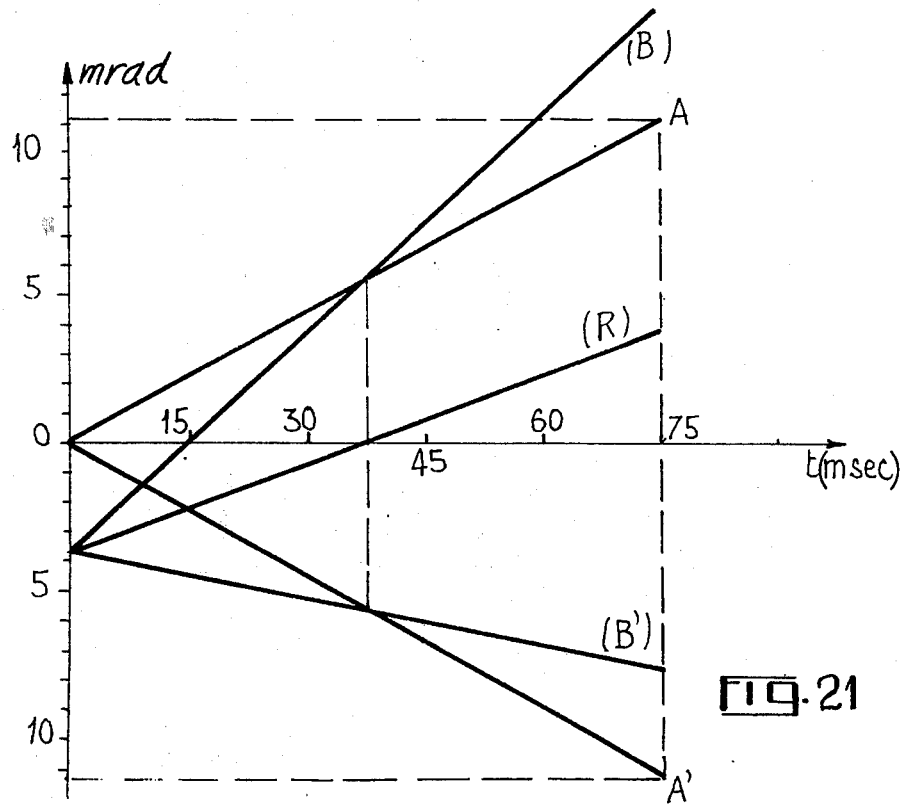
Figure 22:
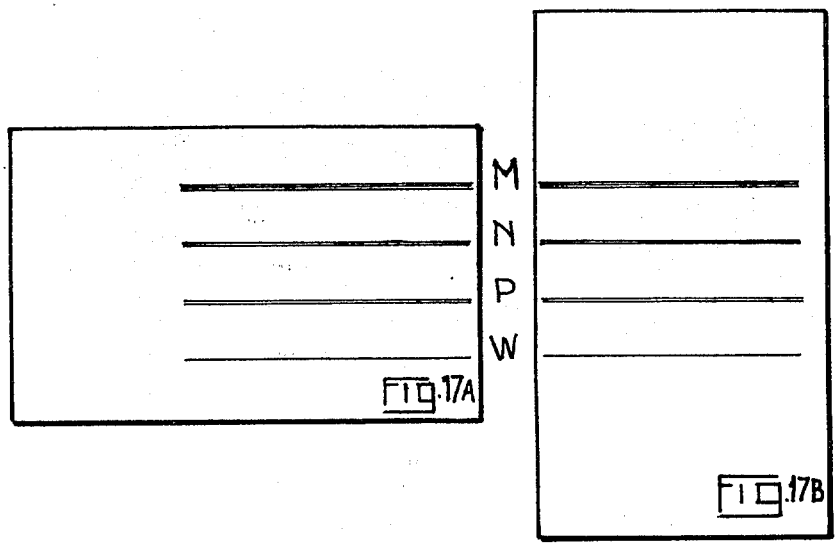
FIG. 22 indicates how FIGS. 17 A and 17 B are interconnected.

In the specific example given in FIGS. 20 and 21, the lateral component of the target speed is assumed to be 300 m/sec so that, at the distance $d_o = 2000$ m, its angular velocity in the plane of the sweep is 0.15 radian/sec. During the firing period of 70 ms referred in the discussion of sections 17 *g* – 17*i* of FIG. 17, the azimuthal target displacement as seen from the firing point is therefore 10.5 mrad, compared with a sweep rotation (R) of ±3.75 mrad centered on a reference plane ($\phi = 0$) through which the gun passes at the midpoint of the sweep if no tracking occurs.

It is to be understood that the projectiles to be fired by the present system may include time-delay fuses, proximity fuses, impact detonators or the like and that, in its broader aspects, the invention is also applicable to a system for the mondestructive dispatch of a multiplicity of nonguided projectiles to a target area.

We claim:

1. A firing-control system for nonguided projectiles, comprising:

an array of tubular projectile launchers clustered about a main axis;

tracking means for ascertaining the general location of a target to be attacked;

computer means responsive to said tracking means for precalculating a presumed target position;

first drive means controlled by said computer means and operatively coupled with said array for maintaining said axis trained upon said presumed target position in directions diverging in at least one dimension, said array being divided into a plurality of groups of launchers, the launchers of each group having muzzles trained upon different parts of an assigned segment of a predetermined region of uncertainty centered on said presumed targer position;

trigger means operable by said computer means for actuating the launchers of a selected group within a predetermined firing period with simultaneous emission of projectiles from combinations of launchers within the group having their muzzles symmetrically distributed about said main axis for a balanced recoil effect; and second drive means for rotating said array in another dimension at a rate enabling each group to sweep its assigned segment within said firing period.

2. A system as defined in claim 1 wherein each group consists of an even number of launchers, said combinations being pairs of launchers with muzzles in diametrically opposite positions with reference to the main axis.

3. A system as defined in claim 2 wherein the number of launcher pairs is the same for all groups.

4. A system as defined in claim 1 wherein the launchers of each group are arrayed in paired rows generally transverse to said other dimension with the muzzles of each row angularly offset within the plane of rotation in a predetermined firing order, said trigger means being operable to actuate the launchers of each row in said order and at instants in which their muzzles lie in a common transverse plane.

5. A system as defined in claim 1 wherein the projectiles fired from the launchers of each group have zones of effectiveness overlapping throughout the assigned segment within a predetermined distance, said computer means including a range finder for establishing said firing period upon the coming of a target within said distance.

6. A firing-control system for nonguided projectiles, comprising :

an array of tubular projectile launchers clustered about a main axis;

tracking means for ascertaining the general location of a target to be attacked;

computer means responsive to said tracking means for precalculating a presumed target position;

drive means controlled by said computer means and operatively coupled with said array for maintaining said axis trained upon said presumed target position, said array being divided into a plurality of groups of launchers, the launchers of each group having muzzles trained upon different parts of an assigned segment of a predetermined region of uncertainty centered on said presumed target position; and trigger means operable by said computer means for actuating the launchers of a selected group within a predetermined firing period, said computer means including a range finder for establishing said firing period upon the coming of a target within a distance at which the projectiles fired from the launchers of each group have zones of effectiveness overlapping one another throughout the assigned segment.

7. A system as defined in claim 6 wherein the launchers of each group have their muzzles oriented at diverging angles of elevation, further comprising drive means for rotating said array in an azimuthal direction at a rate enabling each group to sweep its assigned segment within said firing period.

8. A firing-control system for nonguided projectiles, comprising :

an array of tubular projectile launchers clustered about a main axis;

tracking means for ascertaining the general location of a target to be attacked;

computer means responsive to said tracking means for precalculating a presumed target position;

first drive means controlled by said computer means and operatively coupled with said array for maintaining said axis trained upon said presumed target position, said array being divided into a plurality of groups of launchers, the launchers of each group having muzzles diverging in a first dimension and trained upon different parts of an assigned segment of a predetermined region of uncertainty centered on said presumed target position;

trigger means operable by said computer means for actuating the launchers of a selected group within a predetermined firing period; and second drive means for rotating said array in a second dimension enabling each group to sweep its assigned segment within said firing period.

9. A system as defined in claim 8 wherein said muzzles diverge within each group in said second dimension to an extent imparting substantially the same angular orientation in the plane of rotation to each muzzle of a group at the instant of firing.

* * * * *